US012234717B2

(12) United States Patent
Shetty et al.

(10) Patent No.: US 12,234,717 B2
(45) Date of Patent: Feb. 25, 2025

(54) EFFECTIVE WELLBORE COMPRESSIBILITY DETERMINATION APPARATUS, METHODS, AND SYSTEMS

(71) Applicant: Halliburton Energy Services, Inc., Houston, TX (US)

(72) Inventors: Dinesh Ananda Shetty, Sugar Land, TX (US); Vladimir Nikolayevich Martysevich, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 978 days.

(21) Appl. No.: 17/278,444

(22) PCT Filed: Nov. 8, 2018

(86) PCT No.: PCT/US2018/059821

§ 371 (c)(1),
(2) Date: Mar. 22, 2021

(87) PCT Pub. No.: WO2020/096603

PCT Pub. Date: May 14, 2020

(65) Prior Publication Data

US 2021/0355814 A1 Nov. 18, 2021

(51) Int. Cl.
*G06F 30/20* (2020.01)
*E21B 47/06* (2012.01)

(52) U.S. Cl.
CPC ..... *E21B 47/06* (2013.01); *E21B 2200/20* (2020.05)

(58) Field of Classification Search
CPC ..... E21B 47/06; E21B 2200/20
USPC ..... 703/9, 10
See application file for complete search history.

(56) References Cited

U.S. PATENT DOCUMENTS

| | | | | |
|---|---|---|---|---|
| 4,597,290 | A | 7/1986 | Bourdet et al. | |
| 8,271,248 | B2 * | 9/2012 | Pomerantz | E21B 49/00 703/10 |
| 9,176,255 | B2 | 11/2015 | Wiener et al. | |
| 2007/0175273 | A1 | 8/2007 | Follini et al. | |
| 2009/0165548 | A1 | 7/2009 | Pop et al. | |

(Continued)

FOREIGN PATENT DOCUMENTS

| | | | | |
|---|---|---|---|---|
| CN | 101560879 | B | 10/2009 | |
| WO | WO-2014148924 | A1 * | 9/2014 | E21B 43/26 |
| WO | 2016192077 | A1 | 8/2016 | |

OTHER PUBLICATIONS

Joshi (Augmentation of Well Productivity With Slant and Horizontal Wells, pp. 1-13). (Year: 1988).*

(Continued)

*Primary Examiner* — Andre Pierre Louis
(74) *Attorney, Agent, or Firm* — DeLizio, Peacock, Lewin & Guerra LLP

(57) ABSTRACT

An apparatus includes a pressure sensor for measuring a pressure in a wellbore of a formation, a processor communicably coupled with the pressure sensor, and a machine-readable medium. The machine-readable medium has program code executable by the processor to cause the apparatus to obtain a set of measurements with the pressure sensor, determine an effective wellbore compressibility coefficient based on the set of measurements, and determine an effective wellbore diameter based on an initial wellbore diameter and the effective wellbore compressibility coefficient.

17 Claims, 5 Drawing Sheets

(56) References Cited

U.S. PATENT DOCUMENTS

| | | | | |
|---|---|---|---|---|
| 2010/0169019 | A1 | 7/2010 | Zhan et al. | |
| 2012/0150515 | A1 | 6/2012 | Hariharan et al. | |
| 2015/0107898 | A1* | 4/2015 | Leuchtenberg | E21B 44/00 175/25 |

OTHER PUBLICATIONS

Yang et al. (Experimental Study on Fracture Initiation by Pressure Pulses, pp. 1-14). (Year: 2000).*

PCT Application Serial No. PCT/US2018/059821, International Search Report, mailed Aug. 7, 2019, 4 pages.

PCT Application Serial No. PCT/US2018/059821, International Written Opinion, mailed Aug. 7, 2019, 6 pages.

Jung, et al., "Re-Examining Interpretations of Non-Ideal Behavior During Diagnostic Fracture Injection Tests", Journal of Petroleum Science and Engineering, Sep. 1, 2016, pp. 114-136.

McClure, et al., "The Effect of Changing Fracture Compliance on Pressure Transient Behavior During Diagnostic Fracture Injection Testes", Society of Petroleum Engineers, 2014.

* cited by examiner

EFFECTIVE WELLBORE COMPRESSIBILITY DETERMINATION APPARATUS, METHODS, AND SYSTEMS

BACKGROUND

The present disclosure relates generally to wellbore treatment operations and, more particularly, to modeling of wellbore treatment operations.

A common method used to determine the long-term performance and properties of a well is to close one or more surface valves of the well to prevent fluid flow. This method, known as a well shut-in, results in corresponding changes in pressure, temperature, produced fluid composition and various other measurable well properties or fluid properties. The tracking and analysis of the measurements corresponding to these measurable properties provide a means of determining various well and fluid properties.

An appropriate analysis of these physical measurements often includes a quantitative understanding of the wellbore storage effect, which describes the phenomenon of fluid flow during a well shut-in. A quantitative understanding of the wellbore storage effect is useful for a variety of analysis methods, such as diagnostic fracture injection testing (DFIT) and well testing interpretation. An accurate prediction of wellbore storage can greatly increase the accuracy of well property and formation property predictions.

BRIEF DESCRIPTION OF THE DRAWINGS

Examples of the disclosure can be better understood by referencing the accompanying drawings.

DESCRIPTION OF EMBODIMENTS

Figure 1:
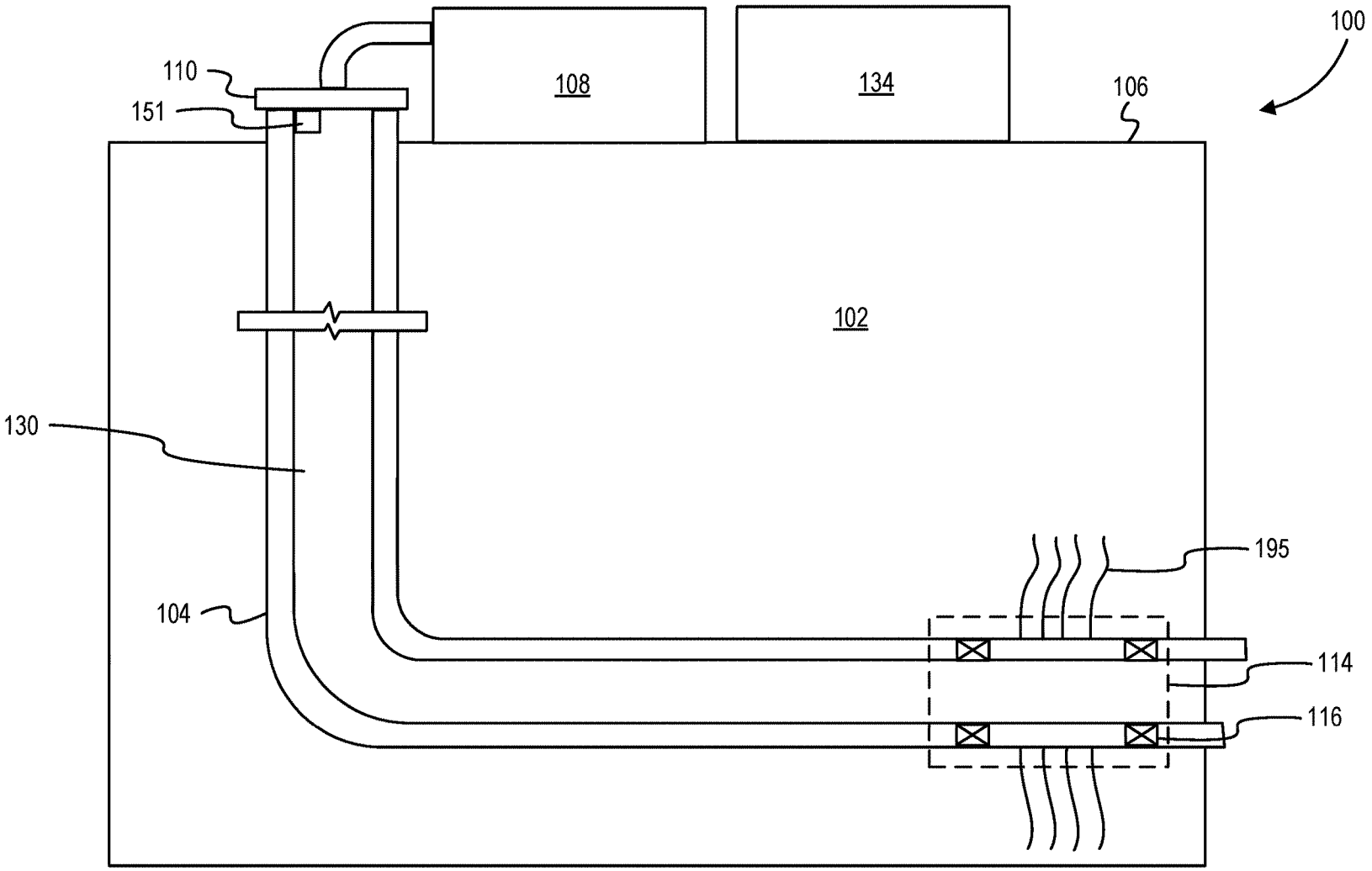
FIG. 1 depicts a diagram of a wellbore with a fracture.

The description that follows includes example systems, methods, techniques, and program flows that embody aspects of the disclosure. However, it is understood that this disclosure can be practiced without these specific details. For instance, this disclosure refers to fluid pressure in illustrative examples. Examples of this disclosure can be also applied to other types of downhole measurements, such as temperature and fluid composition. Other instances, well-known instruction instances, protocols, structures and techniques have not been shown in detail in order not to obfuscate the description.

Various embodiments include a wellbore storage determination system that includes a processor. In some embodiments, the system can obtain a set of pressure measurements from one or more pressure sensors in communication with the processor. The system can determine a wellbore compressibility coefficient based on the pressure measurements. The system can then use the wellbore compressibility coefficient and an initial wellbore diameter to determine an effective wellbore diameter. Once the effective wellbore diameter is determined, the system can perform one or more simulations using the effective wellbore diameter to determine fluid parameters (parameters related to a fluid property or fluid motion) such as a fluid flow rate, fluid volume, fluid temperature, fluid pressure, fluid density, fluid composition, etc.

In some embodiments, the system can perform one or more predictive simulations based a continuity equation as shown in Equation 1, where ρ is a fluid density, A is a cross-sectional area, x is a length parameter, t is time, M is mass flow rate, and $M_{src}$ is a mass source (e.g. leak-off, flowback, etc.):

$$\frac{\partial \rho A}{\partial t} + \frac{\partial M}{\partial x} + M_{src} = 0 \tag{1}$$

The system can combine this with the Navier-Stokes equation shown below in Equation 2 to predict transient flow behavior, wherein P is pressure, g is a projection of gravity, and fric represents friction:

$$\frac{\partial M}{\partial t} + \frac{\partial\left(\frac{M^2}{A}\right)}{\partial x} + \frac{\partial AP}{\partial x} + \rho g + fric = 0 \tag{2}$$

A system can approximate the cross-sectional area A of a wellbore shown above by approximating the area as a circle. For example, the system can use Equation 3 below, where d is the diameter of a wellbore tube:

$$A = \frac{\pi}{4} d^2 \tag{3}$$

As discussed further below, the system can vary d as function of various parameters including an effective wellbore compressibility. By considering d as a function of wellbore compressibility and applying one or more appropriate values to the compressibility, the system can determine a fluid flow rate with greater accuracy. The determination of the fluid flow rate can increase accuracy when applying predictive simulations that account for wellbore storage. This increased accuracy can also provide more accurate information that can be used to start, modify and stop well operations with greater precision and efficiency.

Example Well System

FIG. 1 depicts a diagram of a wellbore with a fracture. A wellbore system 100 depicted in FIG. 1 comprises a wellbore 104 with a wellbore tube 130. The wellbore 104 penetrates at least a portion of a subterranean formation 102 and comprises an injection region 114. One or more fluids can be injected from a surface pump 108 through the wellbore 104 into the subterranean formation 102 via the injection region 114. The subterranean formation 102 can comprise pores initially saturated with reservoir fluids (e.g., oil, gas, and/or water). In certain embodiments, the wellbore system 100 can be treated by the injection of a fracturing fluid, acid, or proppant at the injection region 114 in the wellbore 104. When fluid enters the subterranean formation 102 at the injection region 114, one or more fractures 195 can be opened. In certain embodiments, a diverting agent can enter the injection region 114 and restrict fluid flow. In some embodiments, the fracturing fluid can comprise a diverting agent. In addition, a well control system 134 at a surface 106 can control the surface pump 108, the wellhead 110, valves 116, and various other elements of the wellbore system 100. In addition, the well control system 134 can be used to receive measurements from sensors, perform calculations based on the measurements, and transmit the results of the calculations to other devices/computing systems.

During a well shut-in, the wellhead 110 can be shut to stop fluid from flowing through the wellhead 110. A pressure sensor 151 at the wellhead 110 can measure well pressure as fluid flows into the wellbore tube 130 during a phase of the well shut-in known as a fill-up test. As fluids flow into the wellbore tube 130 via the injection region 114 and various other regions in the wellbore 104, a computing device of the well control system 134 can determine the relationship between pressure and fluid flow. The relationship between pressure and fluid flow can be used to predict fluid parameters and wellbore parameters (i.e. parameters related to the formation that the wellbore is in or the wellbore itself) such as a maximum hydrocarbon volume accessible to the wellbore, wellbore material composition, wellbore geometry, wellbore compressibility, etc. The relationship between pressure and fluid flow can be affected by the wellbore storage effect, which can be accounted for by determining a proper calibration time and determining a more accurate volumetric flow rate in the well.

Example Flowchart

Figure 2:
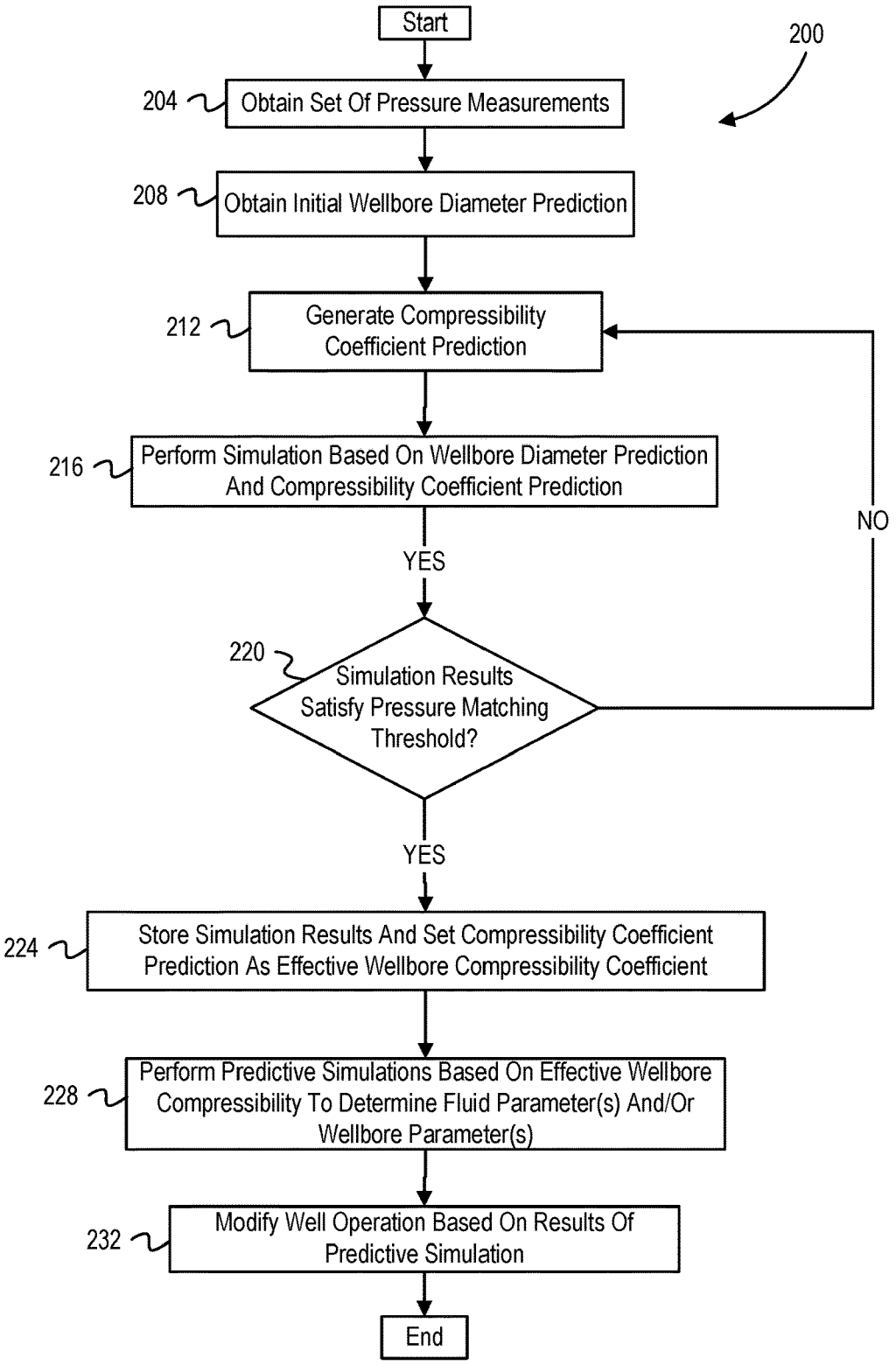
FIG. 2 depicts a flowchart of operations for determining a wellbore storage component.

FIG. 2 depicts a flowchart of operations for determining a wellbore storage component. FIG. 2 depicts a flowchart 200 of operations that are described with reference to a system comprising a processor. Operations of the flowchart 200 start at block 204.

At block 204, the system obtains a set of pressure measurements. The set of pressure measurements can be measured over time and can be obtained from a set of pressure sensors in the wellbore of a formation. For example, with reference to FIG. 1, the set of pressure measurements can be obtained from the pressure sensor 151. The set of pressure measurements can be reported during or more intervals of well shut-in procedure, such as during the initiation of the well shut-in procedure, after a known calibration period, during a subsequent draw-down test, etc. Alternatively, or in addition, the system can obtain measurements prior to a first stage fracturing of the formation.

At block 208, the system obtains an initial wellbore diameter prediction. The system can obtain the initial wellbore diameter by determining a tube diameter and equating the initial wellbore diameter to be equal to the tube diameter. Alternatively, the system can set the initial diameter to be a ratio of the tube diameter or constant value greater than the tube diameter. For example, with reference to FIG. 1, the system can set the initial wellbore diameter to be 10% greater than the diameter of the tube 130 or 2 centimeters greater than the diameter of the tube 130.

At block 212, the system can generate a compressibility coefficient prediction. The compressibility coefficient prediction can be determined by first considering the formation as a deformable material. For example, the system can use Equation 4 below, wherein $d_0$ is equal to the initial wellbore diameter, P is equal to the pressure, σ is equal to an external stress value that can be calculated from formation measurements or estimated from formation properties, v is equal to an effective Poisson ratio, and E is equal to an effective Young's modulus:

$$d = d_0 \frac{1+v}{E}(P-\sigma) \tag{4}$$

In some embodiments, the system can determine E and v using various mechanical models. For example, the system can determine E and v using a cylindrical mechanical model that considers the material properties of the formation, other rock components, a tube, a casing, and other cement materials, etc. Alternatively, the system can approximate the ratio in Equation 4 to the form shown in Equation 5 below, wherein C is a compressibility coefficient prediction:

$$d = d_0 C \frac{1+v}{E}(P-\sigma) \tag{5}$$

As shown above in Equation the, the expression $$\text{“}C\frac{1+v}{E}\text{”}$$

can be interpreted as a predicted wellbore compressibility. In some embodiments, the system can set C to be a constant value. Alternatively, the system can change C as a function of time and/or one or more physical parameters (e.g. pressure, temperature, etc.). For example, the system can set C based on Equation 6, wherein b is a constant value and P is a wellbore pressure value:

$$C=C_0+b\,P^{0.75} \tag{6}$$

At block 216, the system performs a simulation based on the wellbore diameter prediction and compressibility coefficient prediction. The system can perform a simulation based on Equations 1-2, wherein a flow model describing flow through wellbore must satisfy both the continuity equation (shown in its one-dimensional form for Equation 1) as well as the Navier Stokes equation (shown in its one-dimensional form for Equation 2). In some embodiments, the system can specifically incorporate the $$\frac{\partial M}{\partial t}$$

term (i.e. change in fluid mass flow rate over time) and the $$\frac{\partial\left(\frac{M^2}{A}\right)}{\partial x}$$

term (i.e. change in a flow rate over distance) when modeling to account for the Navier-Stokes Equation shown in Equation 2. Alternatively, or in addition, the system can perform multi-dimensional simulations instead. The simulation can use Equation 5, wherein the compressibility coefficient prediction disclosed for block 216 is used for C. The simulation can be performed for any length of simulated time, though in some embodiments, the simulation can be performed for an early test time interval (e.g. measurements taken between the first millisecond to two hours after test initiation). In some embodiments, the system can use a nonlinear solving method such as Newton's method or a machine-learning method when performing the simulation in order to determine the simulation results.

At block 220, the system determines whether the simulation results satisfy a pressure matching threshold. In some embodiments, the system satisfies the pressure matching threshold when an error metric based on a difference between the simulation results and the pressure measurements is less than the pressure matching threshold. Error metrics can include a sum of the difference, a mean squared error (MSE), a root mean square (RMS) error, etc. For example, the system can determine that a MSE between a simulation result and the pressure measurements is 0.03. If the pressure matching threshold for this example is 0.05, the system would determine that the simulation result satisfies the pressure matching threshold. If the system determines that the simulation results satisfy the pressure matching threshold, the system proceeds to block 224. Otherwise, the system returns to block 212 to generate a different compressibility coefficient prediction (e.g. select a different initial value of C, select a different function for C, etc.) and perform a simulation using the different compressibility coefficient at block 216.

At block 224, the system can store the simulation results and set the compressibility coefficient prediction as the effective wellbore compressibility coefficient. The system can store simulation results including values such as simulated measurement times, simulated measurement results, simulated measurement statistics, etc. into a computer-readable storage medium (further described below). The system can set the set the compressibility coefficient prediction as the effective wellbore compressibility coefficient by setting an indicator to indicate that the compressibility coefficient prediction is the effective wellbore compressibility coefficient. Alternatively, the system can generate a new variable or modify a variable value representing the effective wellbore compressibility coefficient based on the value of the compressibility coefficient prediction. Likewise, the system can also set the wellbore compressibility to be the predicted wellbore compressibility described above for block 212.

At block 228, the system can perform predictive simulations based on the effective compressibility coefficient prediction to determine one or more fluid parameters and/or wellbore parameters. The system can use the effective wellbore compressibility coefficient in the flow model described for block 216 to determine fluid parameters such as future flow values in a well and/or flow values for future well operations. Alternatively, or in addition, the system can use the effective wellbore compressibility coefficient to determine other related wellbore parameters such as a wellbore material composition, wellbore geometry, etc.

In some embodiments, the system can use machine learning algorithms to predict the wellbore compressibility. For example, once at least a first wellbore compressibility is determined, the system can generate a function for wellbore compressibility based on measurable properties such as material properties of rock, geometrical information of the wellbore fluid property, etc. that uses machine learning methods. The system can also populate a dataset based on any available historical data, measurements, or determined values. Once this dataset table is prepared, the system can use a machine learning algorithm or another interpolation/extrapolation technique to determine a wellbore compressibility coefficient for future formations before a wellbore is physically drilled.

At block 232, the system modifies well operations based on results of the predictive simulation. The system can modify well operations by starting a well operation, changing a well operation, or stopping a well operation. In some embodiments, the system can determine that a predictive simulation predicts an undesirable effect of a well operation. In response, the system can modify well operations by sending instructions to well components to reduce a fluid injection rate, increase a calibration time, open a flow valve, close a flow valve, etc. For example, the system can use the results of the predictive simulation of a fill-up test and determine that the fill-up test is measuring flow effects while a significant portion (e.g. greater than 5%) of the fluid flowing is being produced from the wellbore itself instead of the surrounding formation. Based on this prediction, the system can extend a calibration time.

The flowchart above is provided to aid in understanding the illustrations and is not to be used to limit scope of the claims. The flowchart depicts example operations that can vary within the scope of the claims. Additional operations may be performed; fewer operations may be performed; the operations may be performed in parallel; and the operations may be performed in a different order. For example, the operations depicted in blocks 200-220 can be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

Example Data

Figure 3:
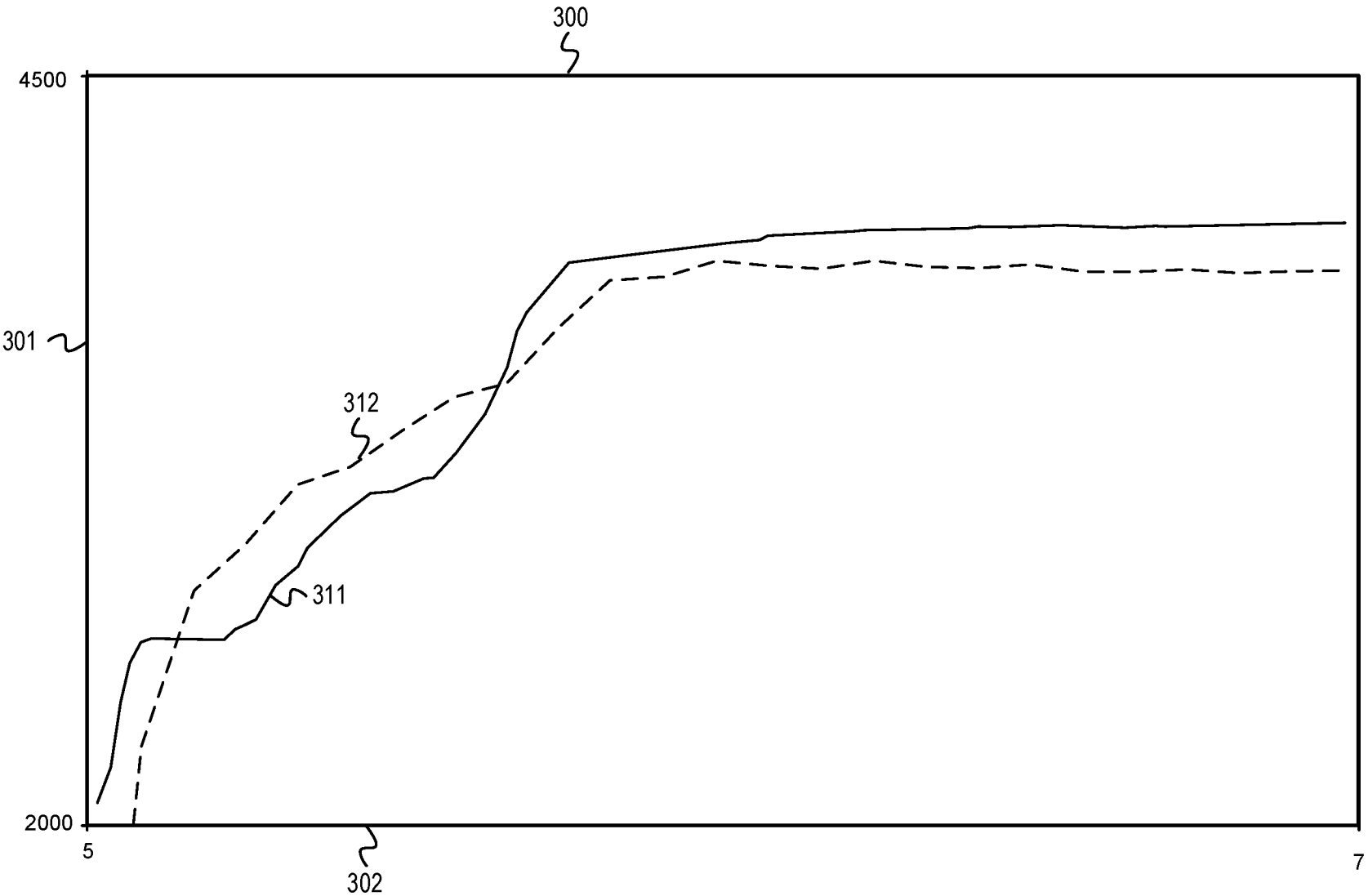
FIG. 3 depicts an example plot showing the use of a comparison between a measured wellbore pressure and a predicted wellbore pressure to determine the wellbore compressibility.

FIG. 3 depicts an example plot showing the use of a comparison between a measured wellbore pressure and a predicted wellbore pressure to determine the wellbore compressibility. The plot 300 includes a vertical axis 301 and a horizontal axis 302. The vertical axis 301 represents pressure in pounds per square inch (psi) and ranges from 1000 psi to 4500 psi. The horizontal axis 302 represents time in minutes and ranges from five minutes to seven minutes. The plot 300 includes actual measurements 311. The actual measurements 311 shows the measurements taken during a fill-up test, which is shown to monotonically increases over time in this example. The plot 300 also includes simulated measurements 312. With reference to FIG. 2 above, a system can perform the operations described for blocks flowchart 204-216 to generate the simulated measurements 312. The system can then compare the simulated measurements 312 with the actual measurements 311 as described for block 220 using a matching threshold of 5%. Using the measurements represented by the plot 300, the system can determine that the MSE value between the simulated measurements 312 and the actual measurements 311 is 3.8%. If the matching threshold for MSE is 5%, then the MSE value is within the matching threshold (i.e. satisfying the matching threshold). Once the system determines that the MSE satisfies the matching threshold, the system can set the compressibility coefficient prediction used to generate the simulated measurement 312 as the effective wellbore compressibility coefficient.

Figure 4:
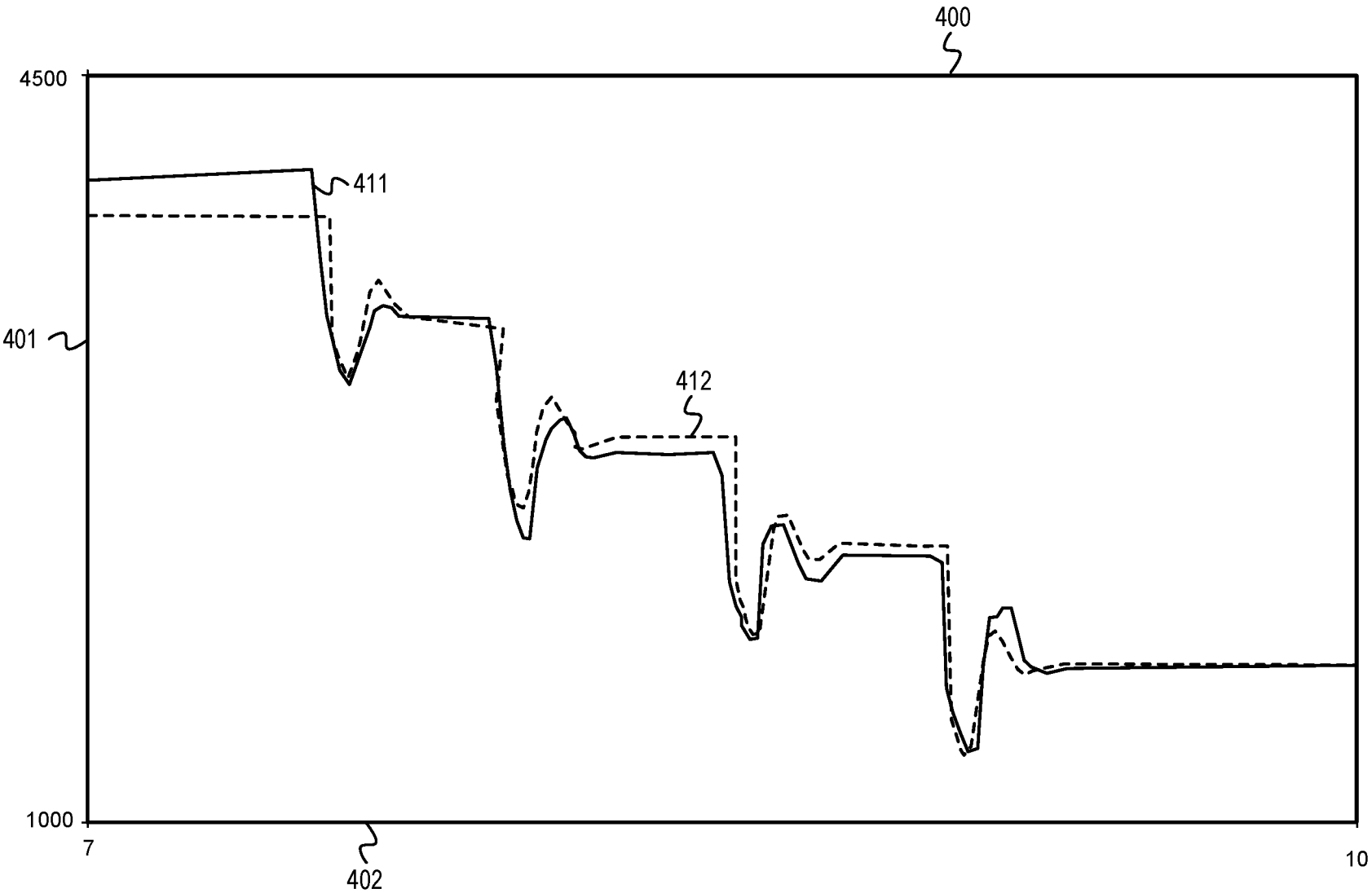
FIG. 4 depicts an example plot contrasting a measured wellbore pressure with a predicted wellbore pressure based on the compressibility used to determine a wellbore pressure during a water hammer test.

FIG. 4 depicts an example plot contrasting a measured wellbore pressure with a predicted wellbore pressure based on the compressibility used to determine a wellbore pressure during a water hammer test. The plot 400 includes a vertical axis 401 and a horizontal axis 402. The vertical axis 401 represents pressure in psi and ranges from 1000 psi to 4500 psi. The horizontal axis 402 represents time in minutes and ranges from 7 minutes to 10 minutes. The actual measurements 411 represent actual measurements taken during a water hammer test using a test fluid. As shown by the actual measurements 411, the pressure tends to decrease with respect to time, but can increase in regular intervals that correspond with water pulses of the water hammer test.

The simulated measurements 412 represents simulated pressure measurements from a water hammer test of the test fluid. With reference to FIG. 2 above, a system can perform the operations described for the flowchart 200 to determine a wellbore compressibility of the test fluid. With further reference to FIG. 3 above, performing the operations described for the flowchart 200 can result in an effective wellbore compressibility determined from the matching based on the simulated measurements 312. The simulated measurements 412 are within 10% of the actual measurements 411 across the entire measurement time shown in the range of the horizontal axis 402. Thus, the system can be used to perform accurate predictive simulations and determine accurate results.

Example Computer Device

Figure 5:
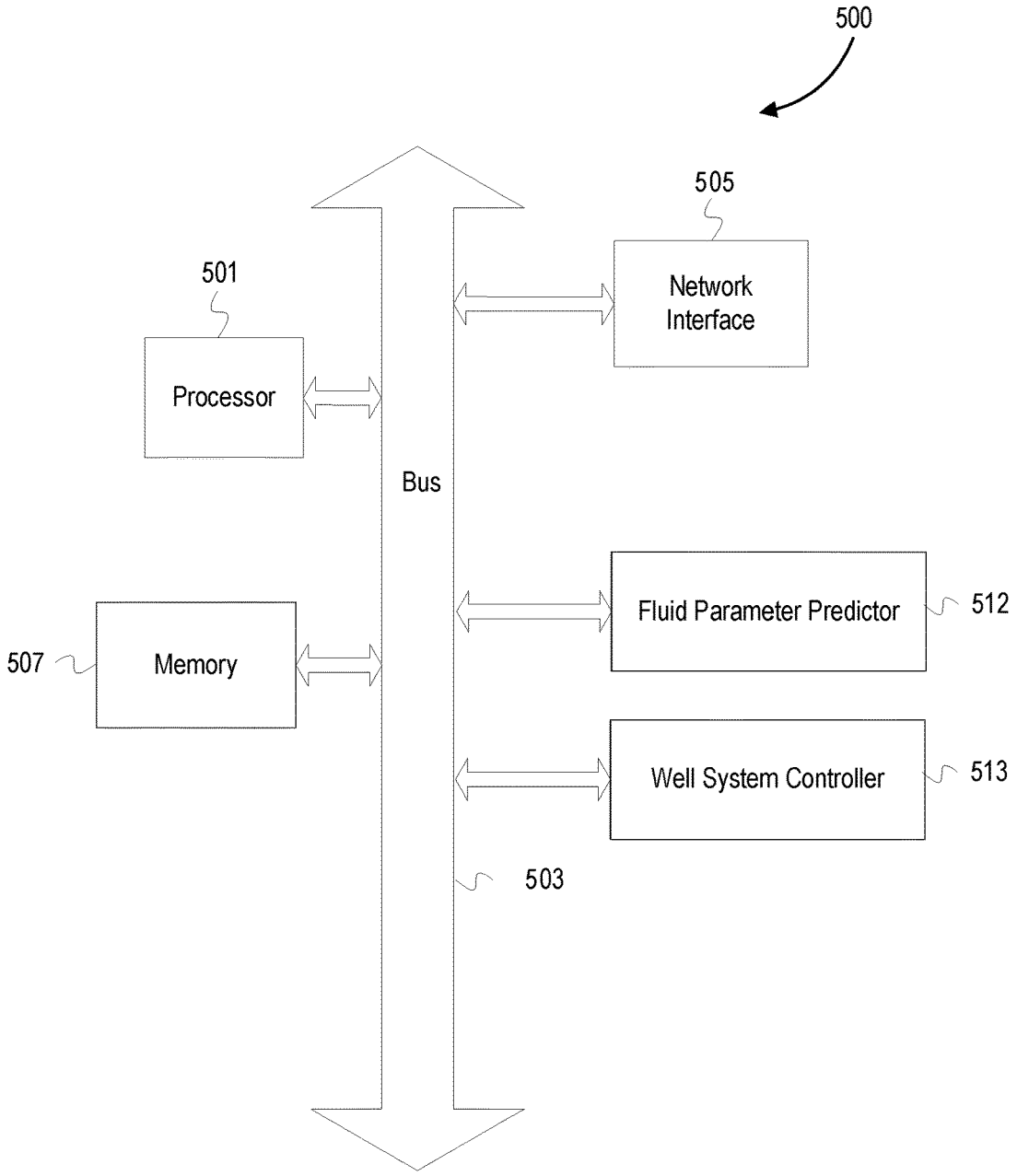
FIG. 5 depicts an example computer device.

FIG. 5 depicts an example computer device. A computer device 500 includes a processor 501 (possibly including multiple processors, multiple cores, multiple nodes, and/or implementing multi-threading, etc.). The computer device 500 includes a memory 507. The memory 507 can be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer device 500 also includes a bus 503 (e.g., PCI, ISA, PCI-Express, HyperTransport® bus, InfiniBand® bus, NuBus, etc.) and a network interface 505 (e.g., a Fiber Channel interface, an Ethernet interface, an internet small computer system interface, SONET interface, wireless interface, etc.).

In some embodiments, the computer device 500 includes a fluid parameter predictor 512 and a well system controller 513. The fluid parameter predictor 512 can perform one or more operations for determining a wellbore compressibility, including generating a compressibility coefficient prediction, performing simulations based on the compressibility coefficient prediction, and/or determining an effective wellbore compressibility coefficient based on compressibility coefficient prediction. A well system controller 513 can also perform one or more operations for controlling a drilling system, well treatment system, or wireline system. For example, the well system controller 513 can change a calibration time, modify the speed of a wireline tool being lowered into a wellbore, or change the pump rate of a fluid into a wellbore. Any one of the previously described functionalities can be partially (or entirely) implemented in hardware and/or on the processor 501. For example, the functionality can be implemented with an application specific integrated circuit, in logic implemented in the processor 501, in a co-processor on a peripheral device or card, etc. Further, realizations can include fewer or additional components not illustrated in FIG. 5 (e.g., video cards, audio cards, additional network interfaces, peripheral devices, etc.). The processor 501 and the network interface 505 are coupled to the bus 503. Although illustrated as being coupled to the bus 503, the memory 507 can be coupled to the processor 501.

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Additional Terminology and Variations

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1: An apparatus comprising: a pressure sensor for measuring a pressure in a wellbore of a formation; a processor communicably coupled with the pressure sensor; and a machine-readable medium having program code executable by the processor to cause the apparatus to, obtain a set of measurements with the pressure sensor; determine an effective wellbore compressibility coefficient based on the set of measurements; and determine an effective wellbore diameter based on an initial wellbore diameter and the effective wellbore compressibility coefficient.

Embodiment 2: The apparatus of Embodiment 1, further comprising program code to modify the effective wellbore compressibility coefficient based on at least one of a change in fluid mass flow rate over time and a change in flow rate over distance.

Embodiment 3: The apparatus of Embodiments 1 or 2, further comprising program code to determine at least one of a fluid parameter or wellbore parameter based on the effective wellbore diameter.

Embodiment 4: The apparatus of any of Embodiments 1-3, further comprising program code to: determine a tube diameter corresponding to a tube in the wellbore; and determine the initial wellbore diameter based on the tube diameter.

Embodiment 5: The apparatus of any of Embodiments 1-4, wherein the program code to determine the effective wellbore compressibility coefficient further comprises program code to determine the effective wellbore compressibility coefficient as varying with respect to the set of measurements.

Embodiment 6: The apparatus of any of Embodiments 1-5, further comprising program code to: generate a dataset comprising a set of wellbore compressibility values and a set of formation measurements, wherein each of the set of wellbore compressibility values correspond with at least one of the set of formation measurements; and train a machine learning algorithm using the dataset.

Embodiment 7: The apparatus of any of Embodiments 1-6, wherein the program code to determine the effective wellbore compressibility coefficient further comprises program code to: generate a compressibility coefficient prediction; perform a wellbore simulation based on the compressibility coefficient prediction; determine whether a match comparison satisfies a match threshold, wherein the match comparison is based on a difference between results of the wellbore simulation and the set of measurements; and set the compressibility coefficient prediction as the effective wellbore compressibility coefficient based on the match comparison satisfying the match threshold.

Embodiment 8: The apparatus of any of Embodiments 1-7, wherein the set of measurements are taken prior to a first stage fracturing of the formation.

Embodiment 9: A method for determining an effective wellbore diameter comprising: obtaining a set of measurements with a pressure sensor in a wellbore of a formation; determining an effective wellbore compressibility coefficient based on the set of measurements; and determining the effective wellbore diameter based on an initial wellbore diameter and the effective wellbore compressibility coefficient.

Embodiment 10: The method of Embodiment 9, further comprising modifying the effective wellbore compressibility coefficient based on at least one of a change in fluid mass flow rate over time and a change in flow rate over distance.

Embodiment 11: The method of Embodiments 9 or 10, further comprising: determining a tube diameter corresponding to a tube in the wellbore; and determining the initial wellbore diameter based on the tube diameter.

Embodiment 12: The method of any of Embodiments 9-11, wherein determining the effective wellbore compressibility coefficient comprises determining the effective wellbore compressibility coefficient as varying with respect to the set of measurements.

Embodiment 13: The method of any of Embodiments 9-12, further comprising: generating a dataset comprising a set of wellbore compressibility values and a set of formation measurements, wherein each of the set of wellbore compressibility values correspond with at least one of the set of formation measurements; and training a machine learning algorithm using the dataset.

Embodiment 14: The method of any of Embodiments 9-13, wherein determining the effective wellbore compressibility coefficient further comprises: generating a compressibility coefficient prediction; performing a wellbore simulation based on the compressibility coefficient prediction; determining whether a match comparison satisfies a match threshold, wherein the match comparison is based on a difference between results of the wellbore simulation and the set of measurements; and setting the compressibility coefficient prediction as the effective wellbore compressibility coefficient based on the match comparison satisfying the match threshold.

Embodiment 15: One or more non-transitory machine-readable media comprising program code for determining an effective wellbore diameter, the program code to: obtaining a set of measurements with a pressure sensor in a wellbore of a formation; determine an effective wellbore compressibility coefficient based on the set of measurements; and determine the effective wellbore diameter based on an initial wellbore diameter and the effective wellbore compressibility coefficient.

Embodiment 16: The machine-readable media of Embodiment 15, further comprising program code to modify the effective wellbore compressibility coefficient based on at least one of a change in fluid mass flow rate over time and a change in flow rate over distance.

Embodiment 17: The machine-readable media of Embodiments 15 or 16, further comprising program code to: determine a tube diameter corresponding to a tube in the wellbore; and determine the initial wellbore diameter based on the tube diameter.

Embodiment 18: The machine-readable media of any of Embodiments 15-17, wherein the program code to determine the effective wellbore compressibility coefficient further comprises program code to determine the effective wellbore compressibility coefficient as varying with respect to the set of measurements.

Embodiment 19: The machine-readable media of any of Embodiments 15-18, further comprising program code to: generate a dataset comprising a set of wellbore compressibility values and a set of formation measurements, wherein each of the set of wellbore compressibility values correspond with at least one of the set of formation measurements; and train a machine learning algorithm using the dataset.

Embodiment 20: The machine-readable media of any of Embodiments 15-19, wherein the program code to determine the effective wellbore compressibility coefficient further comprises program code to: generate a compressibility coefficient prediction; perform a wellbore simulation based on the compressibility coefficient prediction; determine whether a match comparison satisfies a match threshold, wherein the match comparison is based on a difference between results of the wellbore simulation and the set of measurements; and set the compressibility coefficient prediction as the effective wellbore compressibility coefficient based on the match comparison satisfying the match threshold.

What is claimed is:

1. An apparatus comprising:

a pressure sensor for measuring a pressure in a wellbore of a formation;

a processor communicably coupled with the pressure sensor; and a non-transitory machine-readable medium having program code executable by the processor to cause the apparatus to, obtain a set of measurements with the pressure sensor;

determine an effective wellbore compressibility coefficient based on the set of measurements;

determine at least one of: a fluid parameter or a wellbore parameter, or modify a well operation, based on the effective wellbore compressibility coefficient;

generate a dataset comprising a set of wellbore compressibility values and a set of formation measurements, each of the set of wellbore compressibility values corresponding with at least one of the set of formation measurements; and train a machine learning algorithm using the dataset.

2. The apparatus of claim 1, further comprising program code to modify the effective wellbore compressibility coefficient based on at least one of a change in fluid mass flow rate over time and a change in flow rate over distance.

3. The apparatus of claim 1, further comprising program code to determine an effective wellbore diameter based on the effective wellbore compressibility coefficient.

4. The apparatus of claim 1, further comprising program code to:

determine a tube diameter corresponding to a tube in the wellbore; and determine the initial wellbore diameter based on the tube diameter.

5. The apparatus of claim 1, wherein the program code to determine the effective wellbore compressibility coefficient further comprises program code to determine the effective wellbore compressibility coefficient as varying with respect to the set of measurements.

6. The apparatus of claim 1, wherein the program code to determine the effective wellbore compressibility coefficient further comprises program code to:

generate a compressibility coefficient prediction;

perform a wellbore simulation based on the compressibility coefficient prediction;

determine whether a match comparison satisfies a match threshold, wherein the match comparison is based on a difference between results of the wellbore simulation and the set of measurements; and set the compressibility coefficient prediction as the effective wellbore compressibility coefficient based on the match comparison satisfying the match threshold.

7. The apparatus of claim 1, wherein the set of measurements are taken prior to a first stage fracturing of the formation.

8. A method comprising:

obtaining a set of measurements with a pressure sensor in a wellbore of a formation;

determining an effective wellbore compressibility coefficient based on the set of measurements;

determining at least one of: a fluid parameter or a wellbore parameter, or modifying a well operation, based on the effective wellbore compressibility coefficient;

generating a dataset comprising a set of wellbore compressibility values and a set of formation measurements, each of the set of wellbore compressibility values corresponding with at least one of the set of formation measurements; and training a machine learning algorithm using the dataset.

9. The method of claim 8, further comprising modifying the effective wellbore compressibility coefficient based on at least one of a change in fluid mass flow rate over time and a change in flow rate over distance.

10. The method of claim 8, further comprising:

determining a tube diameter corresponding to a tube in the wellbore; and determining the initial wellbore diameter based on the tube diameter.

11. The method of claim 8, wherein determining the effective wellbore compressibility coefficient comprises determining the effective wellbore compressibility coefficient as varying with respect to the set of measurements.

12. The method of claim 8, wherein determining the effective wellbore compressibility coefficient further comprises:

generating a compressibility coefficient prediction;

performing a wellbore simulation based on the compressibility coefficient prediction;

determining whether a match comparison satisfies a match threshold, wherein the match comparison is based on a difference between results of the wellbore simulation and the set of measurements; and setting the compressibility coefficient prediction as the effective wellbore compressibility coefficient based on the match comparison satisfying the match threshold.

13. One or more non-transitory machine-readable media comprising program code executable by a processor to:

obtain a set of measurements with a pressure sensor in a wellbore of a formation;

determine an effective wellbore compressibility coefficient based on the set of measurements;

determine at least one of: a fluid parameter or a wellbore parameter, or modify a well operation, based on the effective wellbore compressibility coefficient;

generate a dataset comprising a set of wellbore compressibility values and a set of formation measurements, each of the set of wellbore compressibility values corresponding with at least one of the set of formation measurements; and train a machine learning algorithm using the dataset.

14. The machine-readable media of claim 13, further comprising program code to modify the effective wellbore compressibility coefficient based on at least one of a change in fluid mass flow rate over time and a change in flow rate over distance.

15. The machine-readable media of claim 13, further comprising program code to:

determine a tube diameter corresponding to a tube in the wellbore; and determine the initial wellbore diameter based on the tube diameter.

16. The machine-readable media of claim 13, wherein the program code to determine the effective wellbore compressibility coefficient further comprises program code to determine the effective wellbore compressibility coefficient as varying with respect to the set of measurements.

17. The machine-readable media of claim 13, wherein the program code to determine the effective wellbore compressibility coefficient further comprises program code to:

generate a compressibility coefficient prediction;

perform a wellbore simulation based on the compressibility coefficient prediction;

determine whether a match comparison satisfies a match threshold, wherein the match comparison is based on a difference between results of the wellbore simulation and the set of measurements; and set the compressibility coefficient prediction as the effective wellbore compressibility coefficient based on the match comparison satisfying the match threshold.

* * * * *